US006595740B1

(12) United States Patent
Drake et al.

(10) Patent No.: US 6,595,740 B1
(45) Date of Patent: Jul. 22, 2003

(54) PREFEEDER ASSEMBLY

(75) Inventors: Jon P. Drake, Chattaroy, WA (US); Michael D. Gerst, Lake Liberty, WA (US)

(73) Assignee: Alliance Machine Systems International, LLC, Spokane, WA (US)

( * ) Notice: Subject to any disclaimer, the term of this patent is extended or adjusted under 35 U.S.C. 154(b) by 0 days.

(21) Appl. No.: 09/674,672

(22) PCT Filed: Apr. 16, 1999

(86) PCT No.: PCT/US99/08419

§ 371 (c)(1),
(2), (4) Date: Mar. 5, 2001

(87) PCT Pub. No.: WO99/54243

PCT Pub. Date: Oct. 28, 1999

Related U.S. Application Data

(60) Provisional application No. 60/082,216, filed on Apr. 17, 1998.

(51) Int. Cl.[7] ..... B65G 59/02

(52) U.S. Cl. ..... 414/796.8; 271/157; 414/773

(58) Field of Search ..... 271/157, 186; 414/796.8, 796, 758, 766, 773

(56) References Cited

U.S. PATENT DOCUMENTS

| | | | | |
|---|---|---|---|---|
| 4,009,789 A | | 3/1977 | Runyan et al. | |
| 4,700,941 A | * | 10/1987 | Shill | 271/151 |
| 4,784,558 A | * | 11/1988 | Toriyama | 414/788.3 |
| 5,039,081 A | * | 8/1991 | Shill | 271/151 |
| 5,358,372 A | | 10/1994 | Meredith | |
| 5,423,657 A | * | 6/1995 | Frost et al. | 414/796.8 |
| 5,743,374 A | | 4/1998 | Monsees | |

* cited by examiner

*Primary Examiner*—Janice L. Krizek
(74) *Attorney, Agent, or Firm*—Dorsey & Whitney LLP

(57) ABSTRACT

An improved prefeeder assembly (10) for receiving a stack (28) of blanks and for inverting and passing the inverted blanks to processing equipment, the prefeeder assembly (10) having a rotator frame (12) which is positonable in an upright load entry position and an inverted bundle discharge position. A rotator infeed conveyor (70) is supported by the rotator frame (12) to receive and support a stack while a lift platform assembly (44) is also supported by the rotator frame (12) to clamp the stack (28) onto the rotator conveyor (70). A backstop and pusher assembly (14) is also supported on the rotator frame (12) and includes a moveable backstop (90) and a pusher member (24) for discharging a selective height of the stack.

31 Claims, 15 Drawing Sheets

PREFEEDER ASSEMBLY

This application claims the benefit of Provisional Application No. 60/082,216, filed Apr. 17, 1998.

TECHNICAL FIELD

The present invention relates to the field of industrial material handling equipment, and more particularly but not by way of limitation, to an improved prefeeder assembly for feeding blanks and the like to processing equipment.

BACKGROUND ART

In the corrugated board industry certain finishing machines are used for the printing and folding of corrugated paper boxes. Such finishing machines can run small and medium sized boxes at high speeds. The collapsed boxes, referred to as blanks, flat boards or flats, can have edge length dimensions as small as about seven by twelve inches and as large as about thirty by seventy-two inches, or even larger. Stacks of large blanks can be as high as six feet and are delivered to a finishing machine for processing; in the case of smaller blanks, the stack height is usually decreased for stability reasons. Most of the finishing machines that are commercially available require the that the blanks be inverted before the blanks are fed into the machine. Once the process is started there can be no interruption in the feed rate of blanks because the quality of the finished box is adversely affected.

When large stacks of blanks are delivered to the finishing machine the blanks must be unstacked and an operator must manually provide handfuls of blanks into the feed hopper of the finishing machine. At the top speed of most finishing machines it is very difficult for operators to manually perform this task throughout a whole work shift. Further, it is quite usual for the finishing machine operation to require that the blanks must be inverted prior to feeding them to the finishing machines, which increases the manual work for the operator.

While prefeeder assemblies are known in the prior art, such prefeeder assemblies can not be operated at high rates of speed, and additionally, prior art prefeeders have problems handling very small blanks throughout the process.

In one type of prior art prefeeding machine, a stack of blanks is conveyed to an inverter where the stack is turned upside down and the blanks are passed from the bottom of the stack to the finishing machine. Another type of prior art prefeeding machine passes a stack of blanks to an elevator which indexes the stack upward, and an overhead pusher mechanism pushes discreet bundles from the top of the stack. The bundles are conveyed in sequence to a bundle inverter which turns each bundle upside down and conveys the inverted bundles to a finishing machine.

While prior art prefeeders may achieve the utility under discussion, there is a need for an improved prefeeder assembly which is capable of handling a range of blank sizes, especially smaller sizes, in an improved manner and with increased speed to overcome the limitations of the known prior art devices.

DISCLOSURE OF INVENTION

The improved prefeeder assembly of the present invention receives a stack of blanks for inverting and passing the inverted blanks to downstream processing equipment. The prefeeder assembly has a rotator frame which is positionable in an upright load entry position and in an inverted bundle discharge position, and a rotator frame actuator assembly supports the rotator frame and rotates the rotator frame between its upright load entry position and its inverted bundle discharge position. A rotator infeed conveyor is provided in the rotator frame to receive the stack of blanks when the rotator frame is in the upright load entry position. A lift platform assembly is also disposed in the rotator frame to clamp the stack on the rotator infeed conveyor during rotation of the rotator frame by the rotator frame actuator assembly.

A backstop and pusher assembly in the rotator frame includes a moveable backstop and a pusher member, the pusher member pushing a selective height of the blanks as a bundle from the stack when the rotator frame is rotated to the inverted bundle discharge position.

Blank bundles pushed from the stack at the inverted bundle discharge position are received by a centering conveyor which centers the blank bundles for delivery to processing equipment on an extendible conveyor. If desired, a shingling station can be provided after the centering conveyor, and tampering means can be provided to straighten the blanks prior to feeding same to processing equipment, such as a finishing machine.

The rotator frame actuator assembly also preferably serves to move the rotator frame along a horizontal path so that the rotator frame is in clearing relationship to other components and the incoming stack of blanks when it is rotated.

The objects, advantages and features of the present invention will be made clear from the following description when read in conjunction with the accompanying drawings.

BRIEF DESCRIPTION OF DRAWINGS

FIG. 8 is a side elevational view of the rotator frame of the prefeeder assembly of FIG. 1.

FIG. 9 is an end elevational view of the rotator frame of FIG. 9.

FIG. 18 is a partial side view of the portion of the lift platform assembly of FIG. 17

FIG. 19 is a top view of the portion of the lift platform assembly of FIG. 17.

BEST MODE FOR CARRYING OUT THE INVENTION

Figure 1:
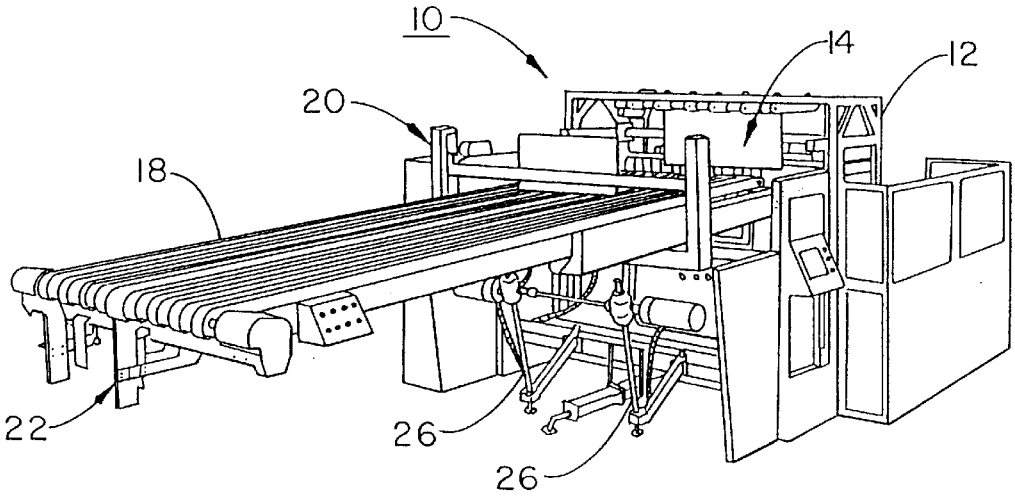
FIG. 1 is a perspective view of a prefeeder assembly constructed in accordance with the present invention.
Figure 2:
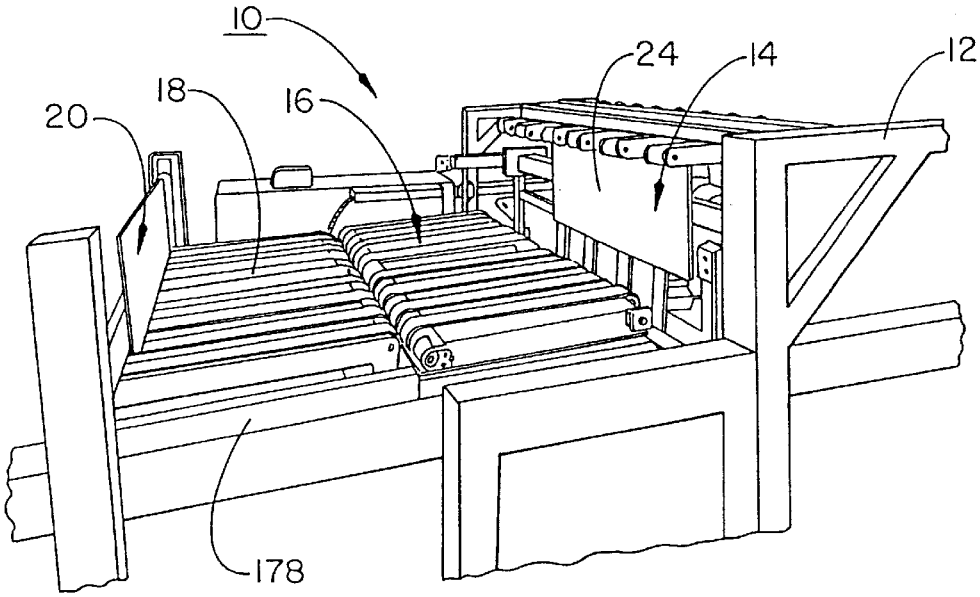
FIG. 2 is an enlarged perspective view of a portion of the prefeeder assembly of FIG. 1.

Referring to the drawings in general, and particularly to FIGS. 1 and 2, shown therein is a prefeeder assembly 10 constructed in accordance with the present invention. FIGS. 1 and 2 show the prefeeder assembly 10 in perspective, and an overview of this assembly will first be undertaken. It will be understood that numerous details of construction will not be provided herein as such details are believed to be unnecessary to teach the construction and use of the present invention to those skilled in the art.

The prefeeder assembly 10 has a rotator frame 12, a backstop and pusher assembly 14, a centering conveyor 16, an extendible conveyor 18, a shingling station 20, and a tamper station 22. Certain of the features of the prefeeder assembly 10 are known in the art and thusly need not be described in detail herein, such as the extendible conveyor 18 (usually referred to as an "extendo" in the industry), the shingling station 20 and the tamper station 22, all of which are well known.

As will be made clear by the fuller description which follows, stacks of blanks are delivered to the prefeeder assembly 10 and such stacks are fed one at a time to the rotator frame 12 which rotates the stack. The backstop and pusher assembly 14 has a pusher member 24 which pushes a discreet number of blanks comprising a bundle from the stack one at a time onto the centering conveyor 16 which centers the bundle and delivers it to the extendible conveyor 18. The extendible conveyor 18 is supported in part by a pair of extendible screw jacks (or extendible cylinders) 26 which pivot the delivery end of the extendible conveyor 18 upwardly to provide proper feed height to the feed table of the finishing equipment and to provide access under the extendible conveyor 18 as necessary. The bundle received by the extendible conveyor 18 passes through the shingling station 20 where the bundle is shingled for delivery to a hopper (not shown) beneath the delivery end of the extendible conveyor 18; as the blanks fall from the delivery end of the extendible conveyor 18 they are tampered by the tamper station 22 to form a uniform bundle stack.

Figure 3:
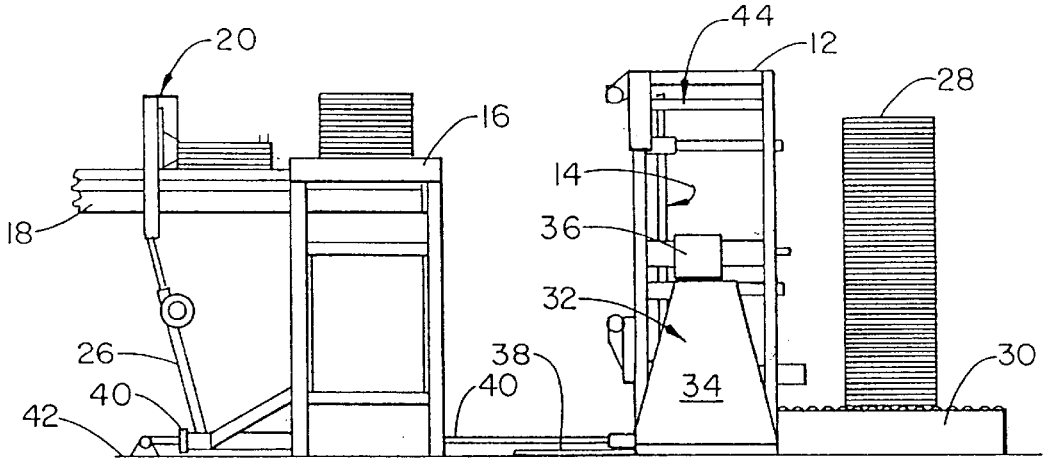
FIG. 3 is a semi-detailed, semi-diagrammatical representation of the prefeeder assembly of FIG. 1 showing the rotator frame thereof in an upright load entry position and disposed for receiving a stack of blanks from a staging conveyor.

Referring now to FIGS. 3 through 7, the prefeeder assembly 10 is shown in various positions as it receives and inverts a stack 28 which has been received from a plant conveyor (not shown) and is disposed on a powered staging conveyor 30 in FIG. 3. The rotator frame 12 is pivotally supported by a rotator frame actuator assembly 32 which has frame 34 and a motor 36 supplied for the purpose of rotating the rotator frame 12. The frame 34 of the rotator frame actuator assembly 32 is supported via rollers (not shown) on tracks 38, and a powered cylinder 40 is disposed as a motive means to move the frame 34 horizontally along a floor support 42.

Disposed within the rotator frame is a rotator infeed conveyor (not numerically designated in the figures presently under discussion), described more fully below, which receives and supports the stack 28 from the staging conveyor 30. A lift platform assembly 44 is supported by the rotator frame 12 to clamp the stack 28 onto the rotator infeed conveyor during rotation thereof.

Figure 4:
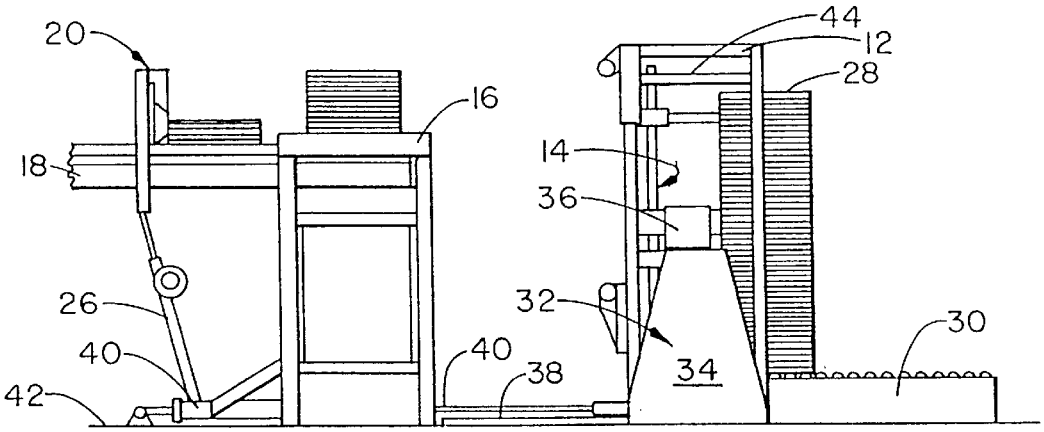
FIG. 4 is a semi-detailed, semi-diagrammatical representation similar to FIG. 3 in which the prefeeder assembly is depicted in the process of onloading the stack of blanks from the staging conveyor.
Figure 5:
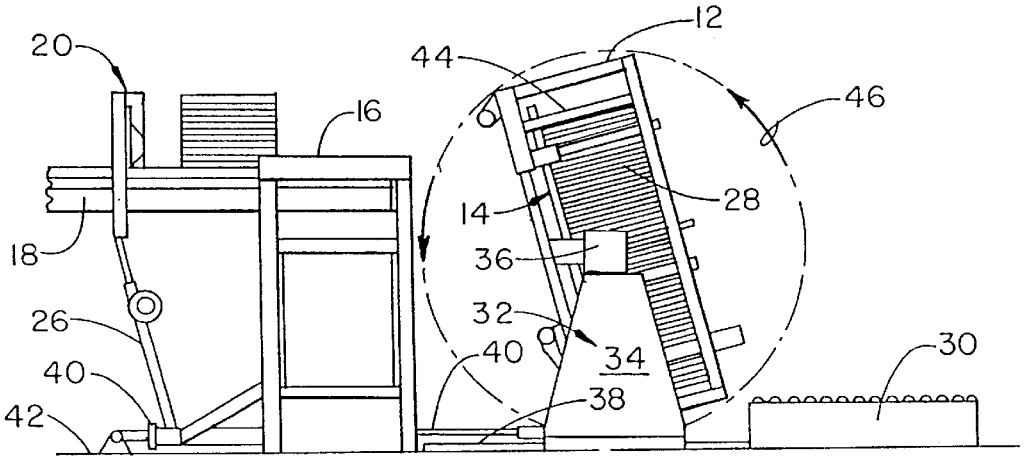
FIG. 5 is a semi-detailed, semi-diagrammatical representation similar to FIG. 4 but depicting the prefeeder assembly having its rotator frame in the process of being rotated to the inverted bundle discharge position thereof

FIG. 3 shows that the stack 28 as supported by the staging conveyor 30 prior to loading onto the rotator frame 12. FIG. 4 shows the stack 28 being delivered by the powered staging conveyor 30 onto the rotator infeed conveyor within the rotator frame 12. FIG. 5 shows the rotator frame actuator assembly 32 moved horizontally away from the staging conveyor 30 via actuation of the power cylinder 40 moving the frame 34 along the tracks 38. Simultaneously, the rotator frame 12 has started its rotation in a counterclockwise direction 46 as the stack 28 is secured by the lift platform assembly 44 and the inlet feed conveyor; as rotation progresses, the stack 28 is also supported by backstop and pusher assembly 14 until rotation is complete.

Figure 6:
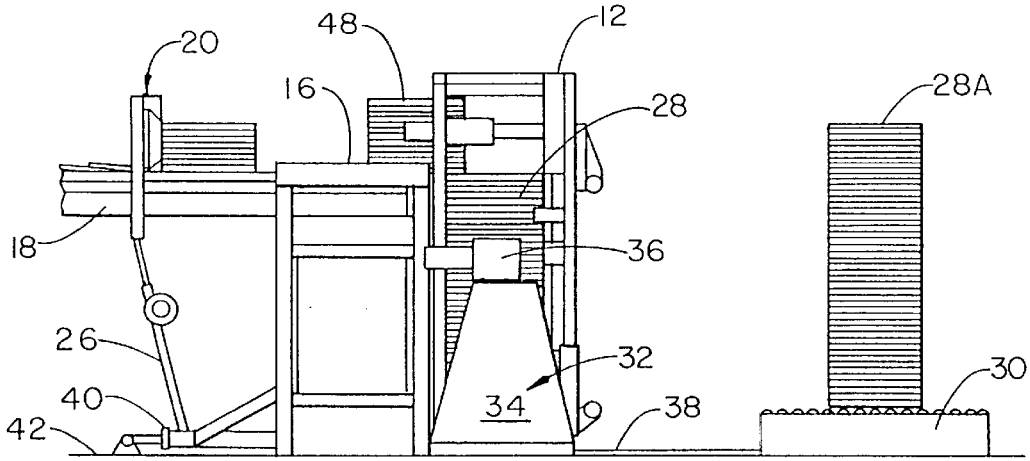
FIG. 6 is a semi-detailed, semi-diagrammatical representation similar to FIG. 5 but with the rotation complete so that the rotator frame is in its inverted bundle discharge position and disposed for offloading bundles from the inverted stack.

FIG. 6 shows that the inversion of the stack has been completed as the rotator frame has been rotated to its inverted bundle discharge position, and the rotator frame 12 has been moved horizontally along the tracks 38 to a position where the rotator frame 12 is in a bundle feeding position relative to the centering conveyor 16, and a bundle 48 is shown being pushed from the top of the inverted stack 28. Actually, with the completion of the rotation of the rotator frame 12 to its inverted bundle discharge position, the stack is supported by the lift platform assembly 44. As will be made clear below, the lift platform assembly 44 is actuated to first lower the stack 28 below the rotator infeed conveyor, following which the lift platform assembly 44 serves to raise the stack 28 in indexed increments to permit the pusher member 24 to push the bundle 48 from the top of the inverted stack 28. Once the bundle 48 is conveyed from the centering conveyor 16, the pusher member 24 is retracted, the lift platform assembly 44 again raises the inverted stack 28, and another bundle 48 is pushed onto the centering conveyor 16. This is repeated until all of the blanks are removed from the rotator frame 12.

Figure 7:
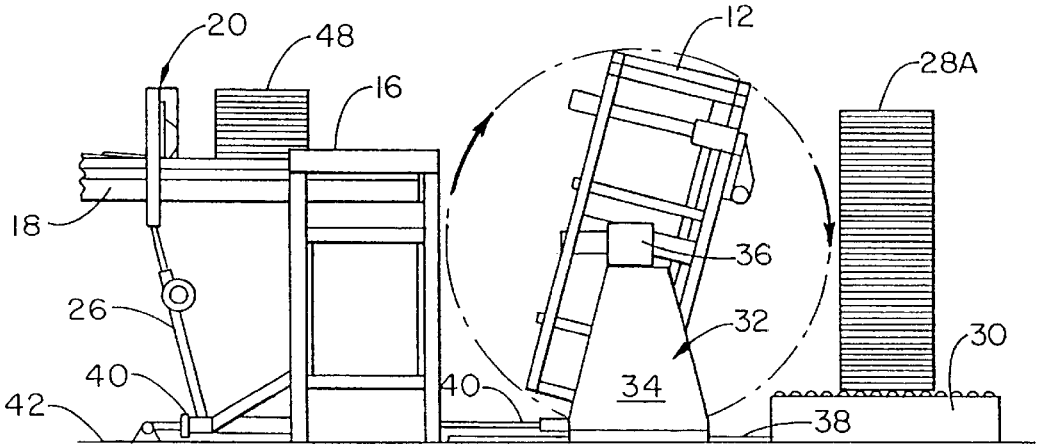
FIG. 7 is a semi-detailed, semi-diagrammatical representation similar to FIG. 6 but with the offloading of the stack having been completed and with the rotator frame being reverse rotated to return it to the onloading position depicted in FIG. 1.
Figure 5:
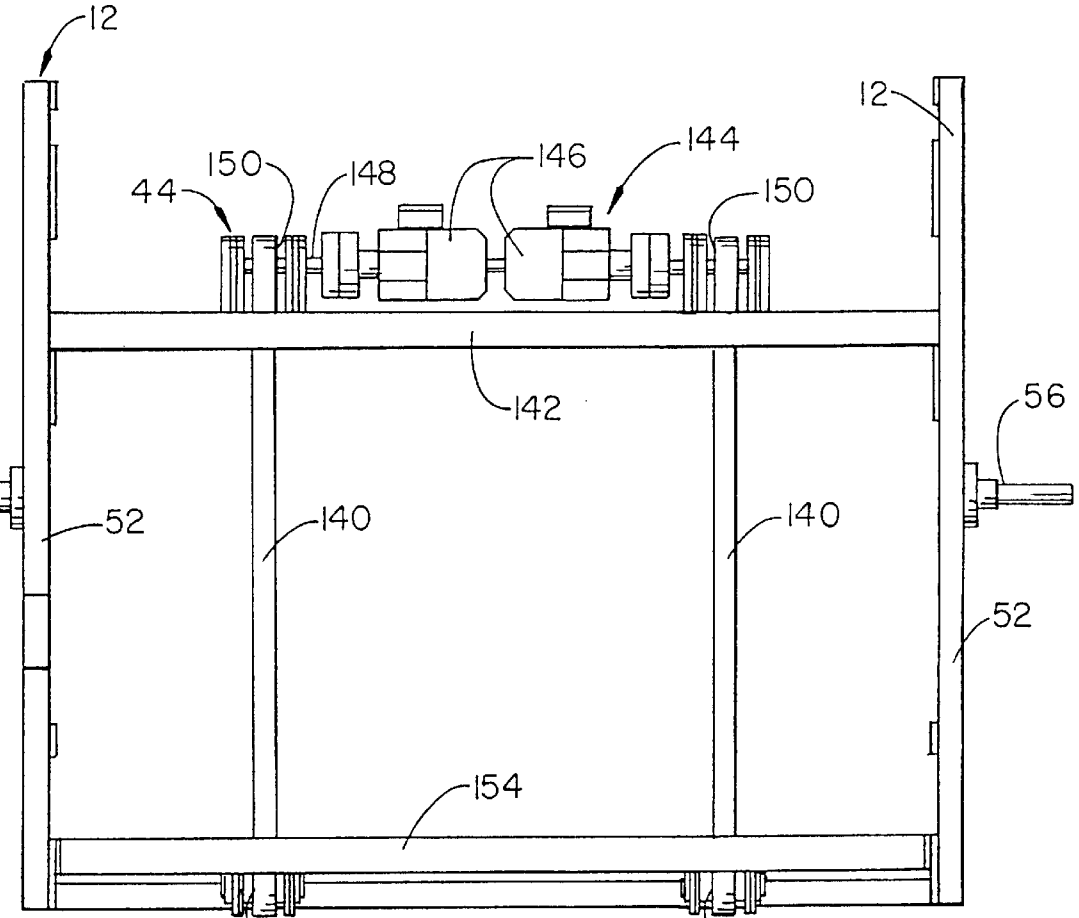

In FIG. 7, shows the rotator frame being reverse rotated via the motor 36 simultaneously with the return of the frame 34 of the rotator frame actuator assembly 32. Another stack 28A has been moved onto the staging conveyor 30 to be loaded onto the rotator frame 12 when returned to its upright load entry position and disposed adjacent to the staging conveyor 30 in the manner shown in FIG. 3.

A description of the present invention will continue generally referencing the prefeeder assembly 10 shown in partial detail in FIGS. 3 through 7 but with some equivalent structural changes. That is, the semi-diagrammatical representations of the prefeeder assembly 10 shown in those drawings were provided for an overview of the structural details, and reference will now be made to the following referenced drawings of components of a similar embodiment of the present invention. For convenience of reference like numerals will be used to designate like components except where noted to the contrary.

Shown in FIGS. 8 and 9 is the rotator frame 12 which comprises a plurality of rigid, vertically extending members 50 and a plurality of rigid, horizontally extending cross members 52 forming a open, box-like structure. Additional undesignated cross members and bracing members are provided as necessary to strengthen this structure. At the vertical center is a cross member 54 on each side, the cross members 54 supporting outwardly extending arbors 56.

Figure 11:
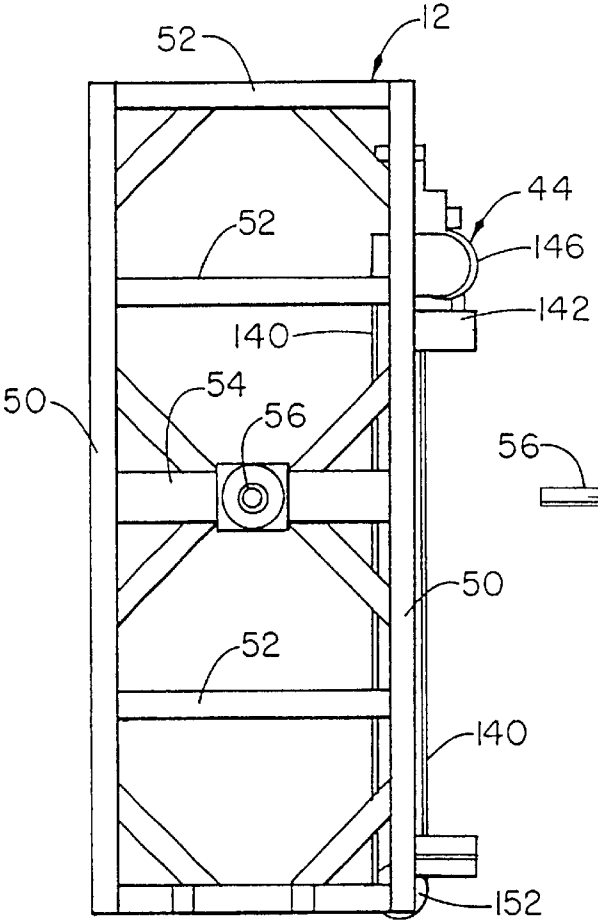
FIG. 11 is a top view of the portion of the prefeeder assembly of FIG. 10 and having the rotator frame shown therein.
Figure 11:
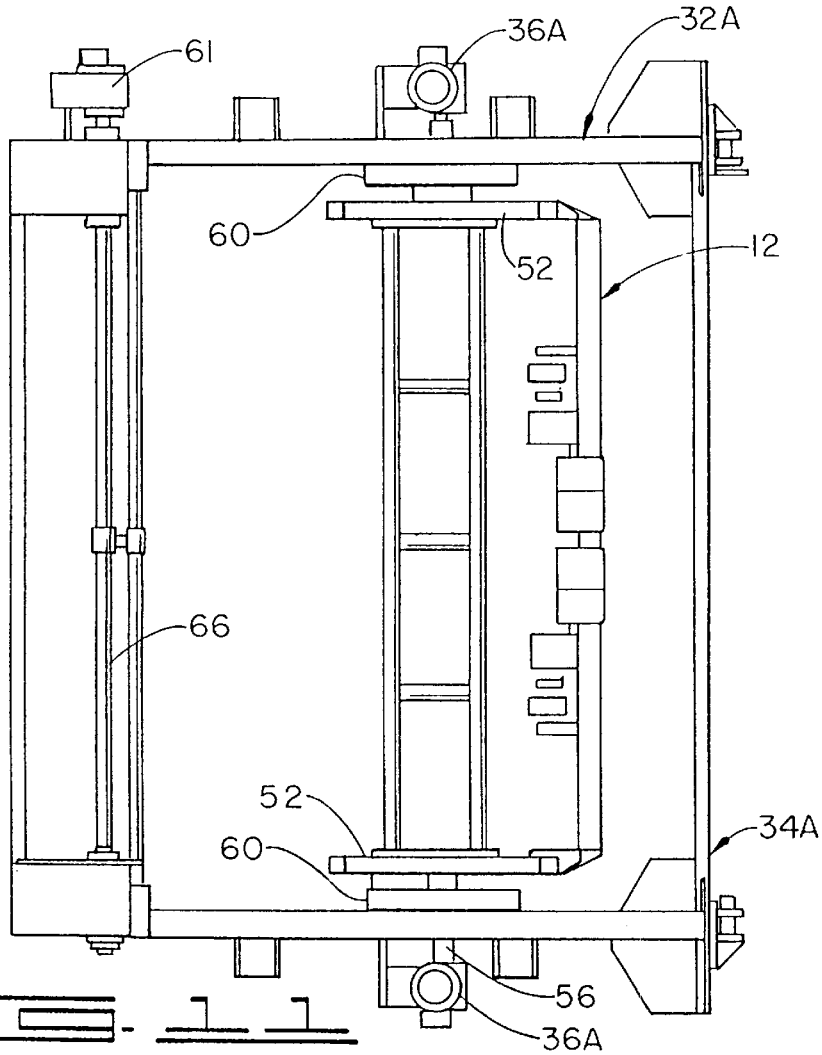
Figure 10:
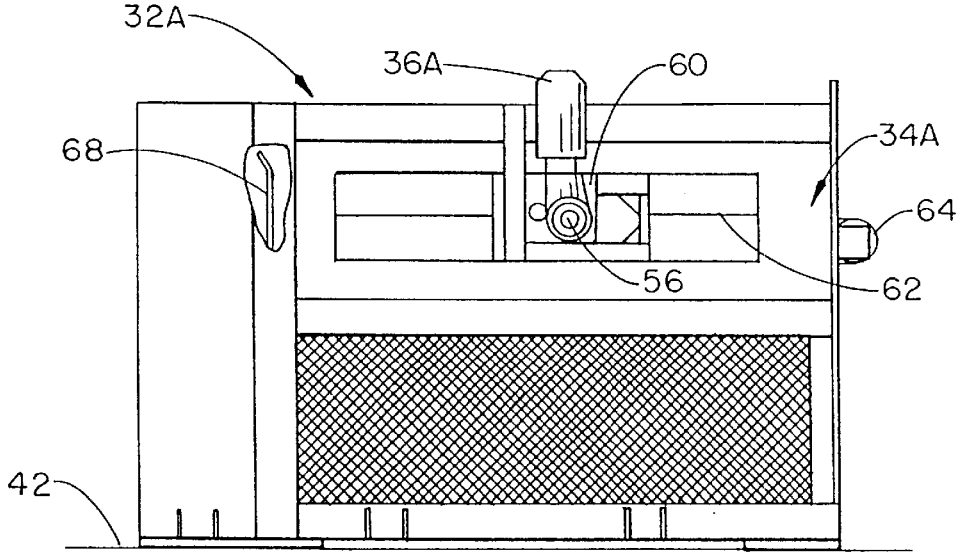
FIG. 10 is a side elevational view of a portion of the prefeeder assembly of FIG. 1 but having a modified rotator frame actuator assembly.

FIGS. 10 and 11 show a rotator frame actuator assembly 32A which comprises a stationary frame 34A which is a rigid, open box-like structure supported on the floor support 42. A portion of the rotator frame 12 is shown in FIG. 11 to depict the orientation of such when supported by the stationary frame 34A. Along each side of the stationary frame 34A is an upper and lower rail member (not shown), or equivalent support structure, which moveably support a pair of travel carts 60, one on each side of the rotator frame 12. The travel carts 60 are rigid structural members which bearingly support the arbors 56 which extend from the rotator frame 12. A pair of motors 36A are drivingly connected to the arbors 56; that is, the arbors 56 are appropriately keyed and gears are provided on the arbors 56 so that the motors 36A are drivingly connected thereto to selectively rotate the frame 12 when supported on the rotator frame actuator assembly 32A. The motors 36A are preferably encoder controlled so as to be controlled via a conventional PLC (programmable logic circuit; not shown) to rotate the rotator frame in a controlled manner as desired. The PLC, it will be understood, can be positioned in any convenient location, such as in a operator console (not shown).

Each of the travel carts 60 is connected to a drive chain 62 which is drivingly supported by a pair of sprockets, each pair having a drive sprocket and an idler sprocket, one such idler sprocket 64 shown in FIG. 10. A motor 61 is drivingly connected to the drive sprockets (not shown) of each pair of sprockets via chain drives (not shown) and a crossing drive shaft 66. The motor 61 is preferably encoder equipped so as to be controlled via the conventional PLC to effect travel of the travel carts 60 in unison along their rail members (or equivalents) to move the supported rotator frame 12 horizontally along the stationary frame 34A.

The stationary frame 32A has protective side panels as shown, one of which is partially cutaway to display a vertically extending plate member 68 which is disposed at entry of the centering conveyor 16 (not shown in FIG. 10), and the bundles 48 of blanks are pushed over this plate member 68 by the pusher member 24 (also not shown in this drawing) when the rotator frame 12 is inverted and translated horizontally to the position depicted in FIG. 6. The plate member 68 is shown in FIG. 10 as a visual aid to understanding the cooperative and spatial orientation of the above described components.

Figure 12:
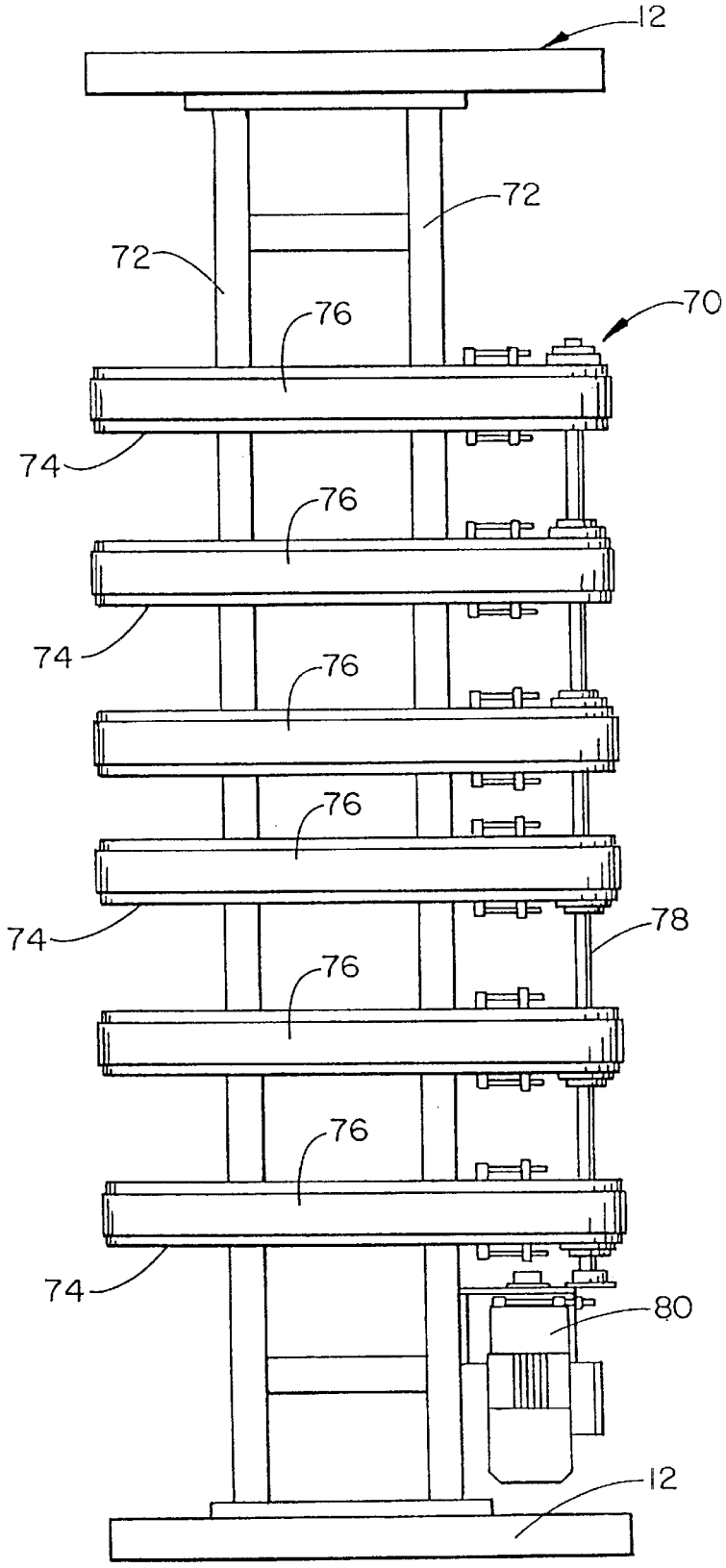
FIG. 12 is a top plan view of the rotator infeed conveyor of the prefeeder assembly of FIG. 1.

Turning now to the interior components found within the rotator frame 12, shown in FIG. 12 is an rotator infeed conveyor 70. As shown, the rotator infeed conveyor 70 has a pair of spaced apart support members 72 which span the rotator frame 12 and are attached thereto. A plurality of belt guide members 74 and supported belt sheaves (not shown) support an equal number of endless conveyor belts 76, and a drive shaft 78 interconnects all of the drive sheaves as shown. A motor 80 is drivingly connected to the drive shaft 78 that drivingly interconnects the drive sheaves which drive the conveyor belts 76 in unison. The rotator infeed conveyor 70 is disposed within the rotator frame 12 and at the bottom end thereof when the rotator frame 12 is in its upright load entry position such as depicted in FIG. 3. The function of the rotator infeed conveyor 70 is to receive the stack 28A and subsequent stacks of blanks and to support same during the rotation of the rotator frame 12 from the upright load entry position to the inverted bundle discharge position such as is shown in FIG. 6.

Figure 14:
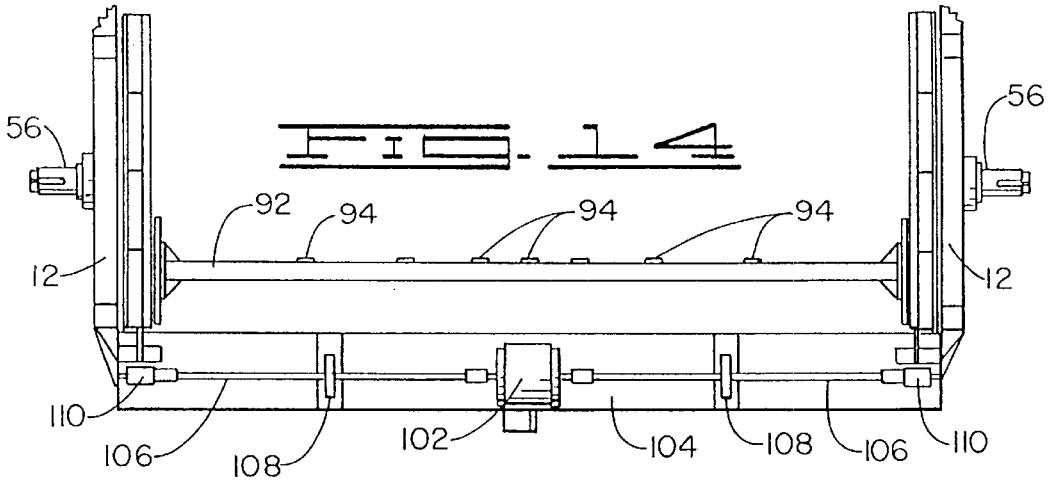
FIG. 14 is a top view of the portion of the backstop and pusher assembly of FIG. 13.
Figure 15:
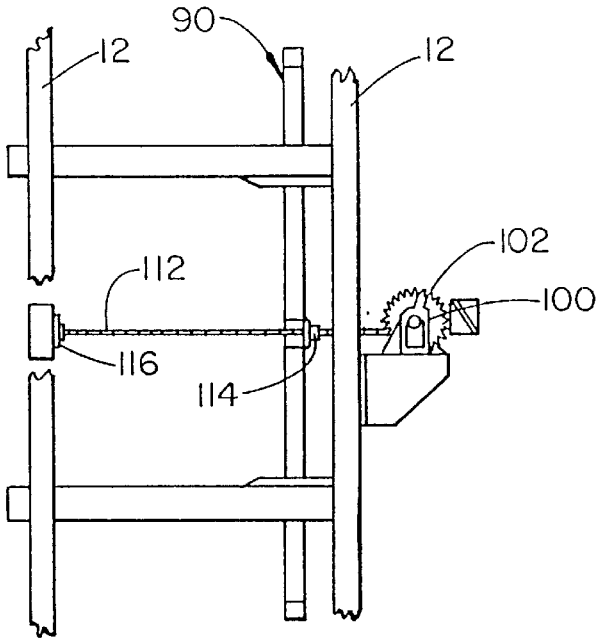
FIG. 15 is a semi-detailed, semi-diagrammatical view of the portion of the backstop and pusher assembly of FIGS. 13 and 14.

Next, the backstop and pusher assembly 14 will be described with reference to FIGS. 13 through 15 wherein the backstop and pusher assembly 14 is shown to comprise a backstop 90 which is a frame having horizontal cross members 92 and attached vertical members 94. The backstop 90 has upper and lower roller assemblies 96 that are rollingly engaged with, and supported by, tracks 98 attached to the rotator frame 12.

A backstop motive assembly 100 comprises a motor 102 supported on a cross member 104 attached to and spanning the rotator frame 12. The motor 102 drives a pair of drive shafts 106 which are supported via shaft mounts 108 supported on the horizontal cross member 104 attached to the rotator frame 12; the drive shafts 106 engage a pair of screw drives 110 that turn a pair of screw members 112, each of the screw members 112 engaging a screw bearing 114 and an end bearing support 116. The screw bearings 114 are mounted to the backstop 90 and the end bearing supports 116 are mounted to the rotator frame 12 as shown in FIG. 15.

It will be understood that rotation of the screws 112 via the motor 102 causes the movement of the backstop 90 relative to the rotator frame 12 to determine the depth of support in the rotator frame 12 for accommodating different sizes of blanks forming the blank stack 28A. That is, by setting the backstop 90 along the screws 112, the distance from the front of the rotator frame 12 along the rotator infeed conveyor 70 is determined, thereby assuring that the stack 28 is positioned against the backstop 90 when moved into the rotator frame 12 via the rotator infeed conveyor 70 from the staging conveyor 30.

Figure 13:
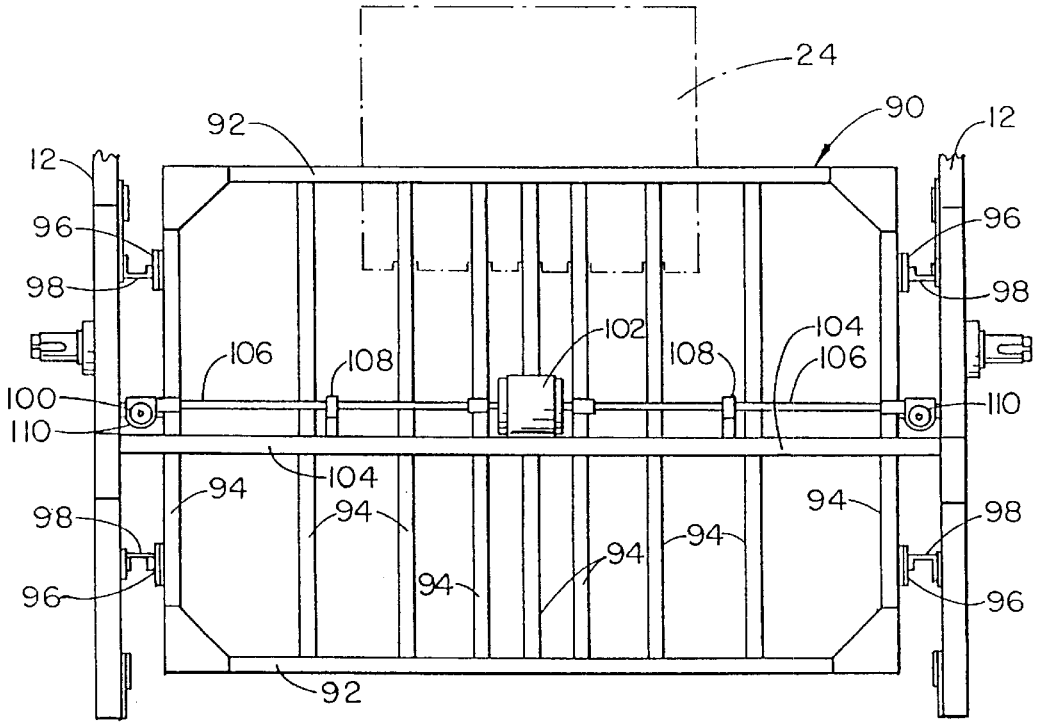
FIG. 13 is an elevational end view of a portion of the backstop and pusher assembly of the prefeeder assembly of FIG. 1, and the pusher member is depicted in phantom lines to indicate the relative position thereto.
Figure 16:
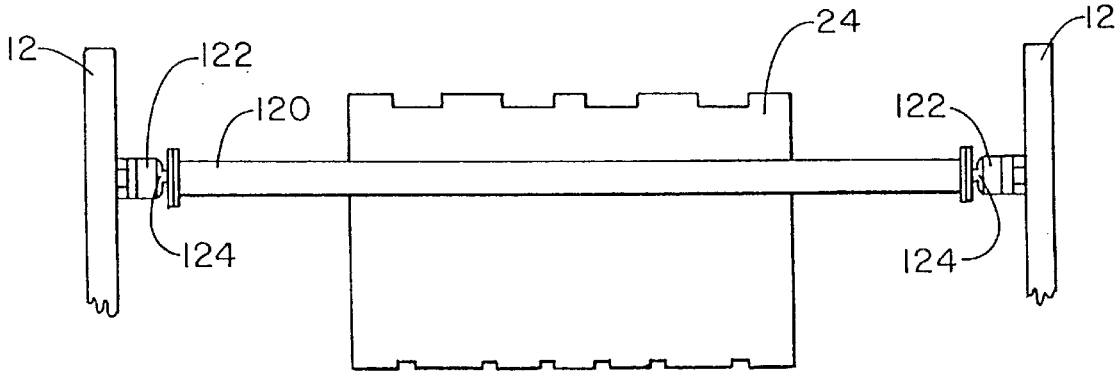
FIG. 16 is a rear elevational view of pusher member of the prefeeder assembly of FIG. 1.
Figure 15:
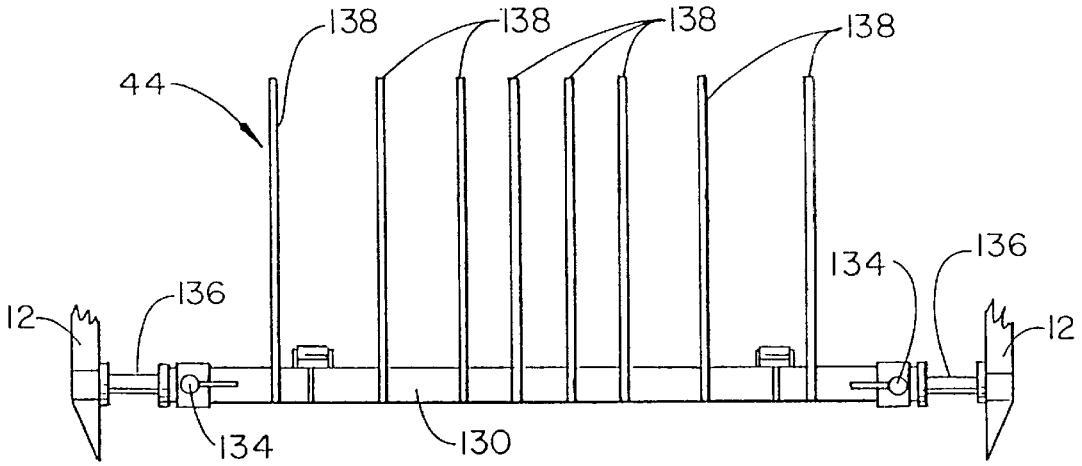
Figure 16:
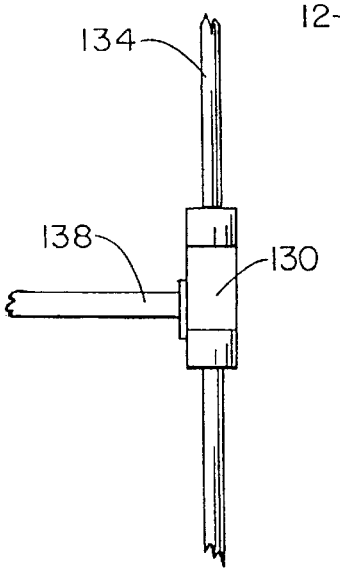

A component of the backstop and pusher assembly 14 is the pusher member 24 which is shown in FIG. 16 as attached to a support beam 120 and is disposed in near proximity to the backstop as shown in phantom lines in FIG. 13. With continued reference to FIG. 16, a pair of conventional rodless cylinders 122 are supported by the rotator frame 12, and each end of the support beam 120 is attached to travel carriage portions 124 of one of the rodless cylinders 122.

Preferably, the rodless cylinders 122 are pneumatic or hydraulic cylinders, and that a fluid source (not shown) is provided to actuate the movement of the travel carriages 124 to move the pusher member 24 as required to push a bundle of blanks from the stack 28A as previously described. Of course, it will be appreciated that the support beam can be moveably supported on the rotator frame by equivalent means such as travel rails or a travel chain, and that other motive means such as motor driven belts or chains can be provided without departing from the spirit of the present invention.

Figure 17:
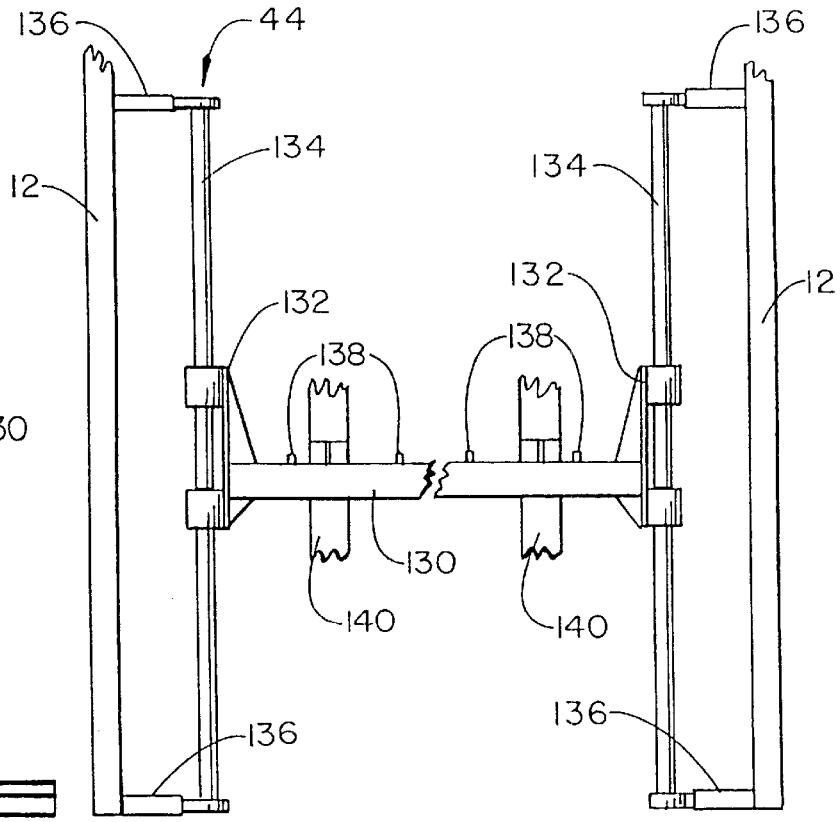
FIG. 17 is a fragmented, semi-detailed elevational view of a portion of the lift platform assembly of the prefeeder assembly of FIG. 1.
Figure 23:
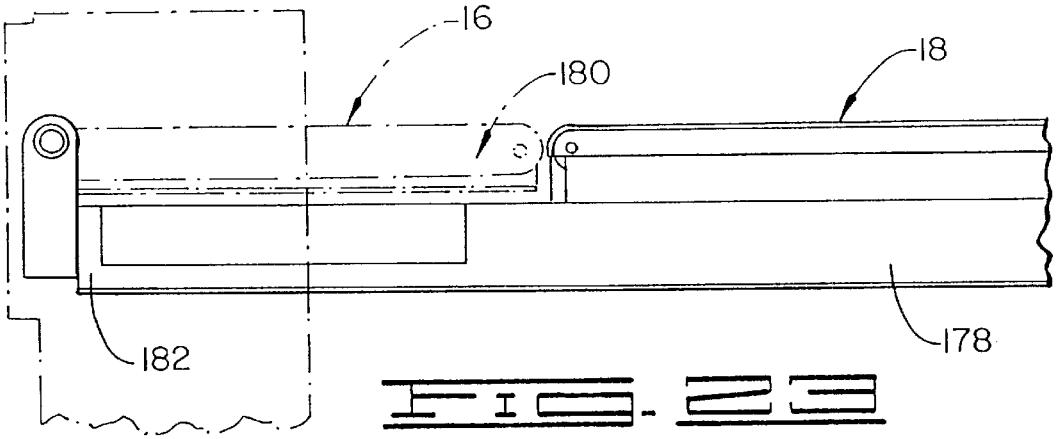
FIG. 23 is a partial, side elevational view of the proximal end of the extendible conveyor of the prefeeder assembly of FIG. 1.
Figure 20:
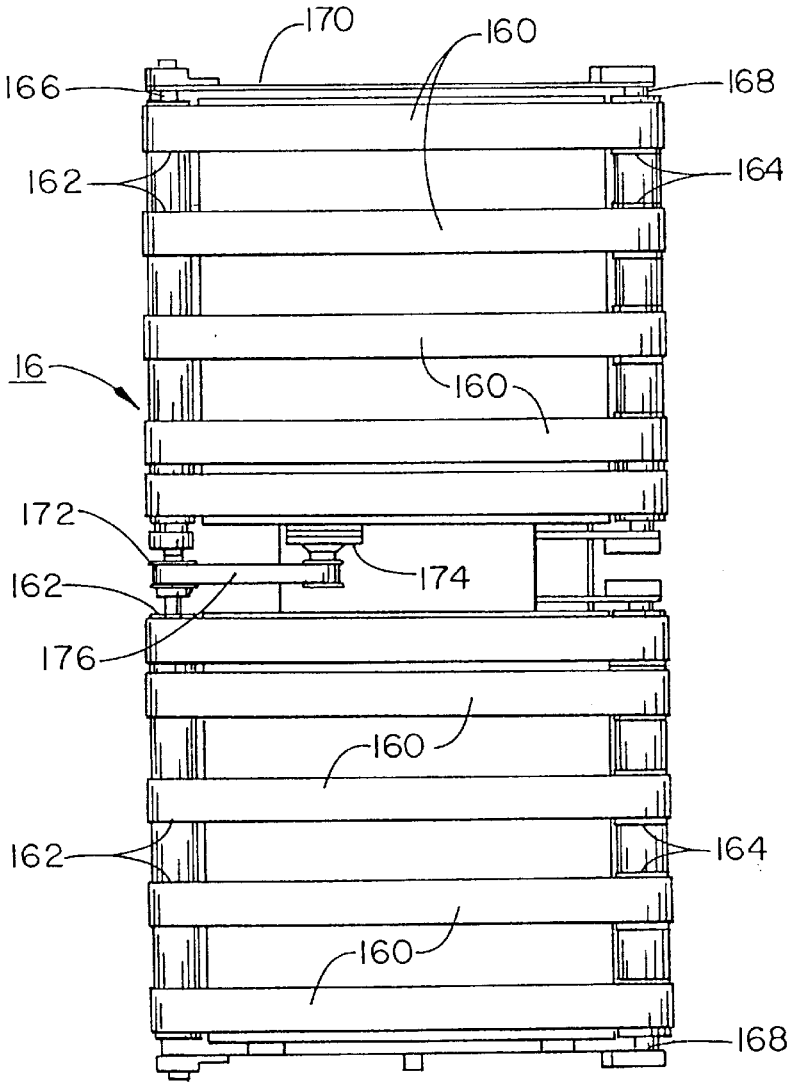
FIG. 20 is a top plan view of the centering conveyor of the prefeeder assembly of FIG. 19.

Also disposed within, and supported by, the rotator frame 12 is the lift platform assembly 44 discussed above and shown in component detail in FIGS. 17 through 19. The lift platform assembly 44 has a cross extending lift beam 130 the ends of which is attached to a pair of travel members 132 that slidingly grip vertically extending slide posts 134 supported by the rotator frame 12 via support members 136. A plurality of stack lift members, or forks, 138 are attached to, and support from, the lift beam 130 as shown. A pair of lift belts 140 are attached to the lift beam 130 and which also are shown in FIGS. 8 and 9 which will now be referenced.

A support member 142 extends across, and is attached to, the rotator frame 12, and supported thereon is a lift drive assembly 144 which comprises a pair of motors 146 which power the selective rotation of a drive shaft 148 to which is attached a pair of belt drive sheaves 150. A pair of belt support sheaves 152 are supported by another cross support member 154 which is in turn attached to the rotator frame 12. The lift belts 140 are endless belts which are disposed over the belt drive sheaves 150 and the support sheaves 152 so that actuation of the motors 146 effect rotation of the belt drive sheaves 150 to selectively raise or lower the lift beam 130 along the slide posts 134.

The centering conveyor 16 will now be described with reference to FIGS. 20 through 23. The centering conveyor 16 comprises a plurality of endless conveyor belts 160 supported by drive sheaves 162 and support sheaves 164 supported, respectively, by a drive shaft 166 and a pair of support shafts 168. The drive shaft 166 and the support shafts 168 are bearingly supported by a centering conveyor frame 170, and a power sheave 172 is supported by the drive shaft 166. A drive motor 174 is supported in a sling support mounted to the centering conveyor frame 170, and a conveyor drive belt 176 extends between the drive motor 174 and the power sheave 172 to power the conveyor belts 160.

Figure 21:
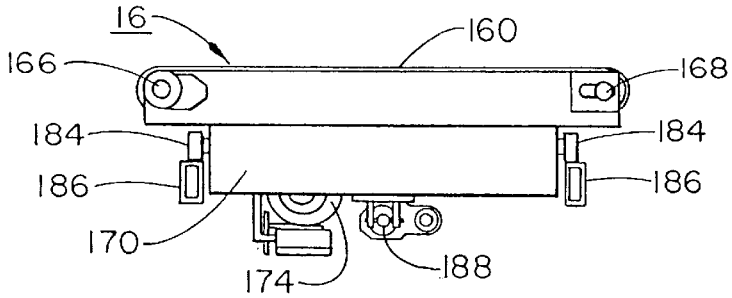
FIG. 21 a side view of the centering conveyor of FIG. 20.
Figure 22:
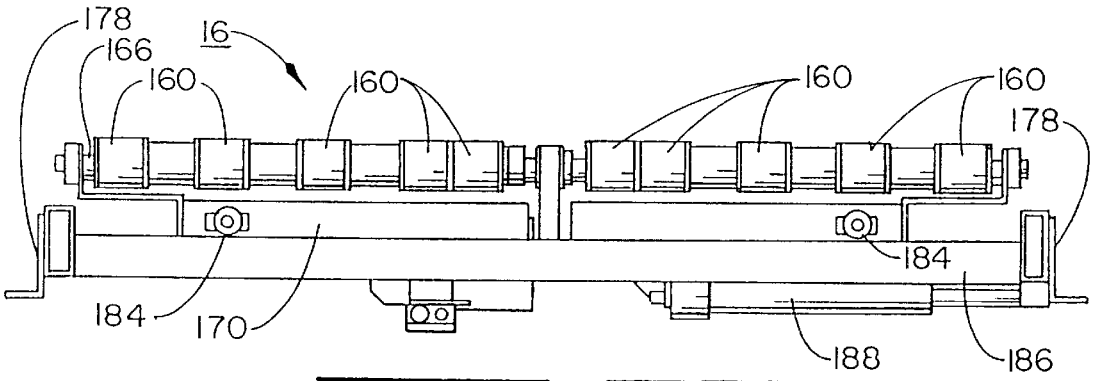
FIG. 22 is an elevational end view of the centering conveyor of FIG. 20.

The centering conveyor 16, as shown in FIG. 2, is disposed to convey the bundles pushed from the stack 28A to the extendible conveyor 18. Returning to FIG. 23, it will be noted that the extendible conveyor 18 has a longitudinally extending frame 178 and that a centering conveyor cavity 180 is formed at the proximal end 182 thereof. The centering conveyor 16 is disposed within the centering conveyor cavity 180 and is supported as follows therein. The centering conveyor frame 170 has a plurality of support rollers 184 extending therefrom as shown in FIGS. 21 and 22 which are in supporting engagement with a pair of cross members 186 of the frame 178 of the extendible conveyor 18. An extendible cylinder 188 is attached between the frame 178 and the centering conveyor frame 170, and upon selective actuation, serves to move the centering conveyor 16 relative to the extendible conveyor 18 for the purpose of centering the bundles received from the rotator frame 12 relative to the extendible conveyor 18.

Prior to discussing the operation of the prefeeder assembly 10, embodiments of FIGS. 24 through 27 will be described. It is often the case that the stacks 28 will be delivered to the staging conveyor 30 on dunnage sheets, and it is necessary to dispose of these dunnage sheets automatically as opposed to having the machine slowed by manual removal of such dunnage sheets. This is accommodated by the embodiments of FIGS. 24 and 25 in which is shown a modified pusher member 24A which is identical in construction and operational detail to the previously described pusher member 24 with the exceptions now noted. The pusher member 24A has a first plate member 190 and a second plate member 192 which are joined by a hinge 194 attached via bolting or the like along the adjacent edges as shown. A pneumatic cylinder 196 (or an equivalent hydraulic or mechanical device) is supported via a bracket 198 and cross member 200 secured to the back of the first plate member 190, and the rod portion of the pneumatic cylinder 196 is attached to a protruding lug 202 on the back of the second plate member 192.

Figure 24:
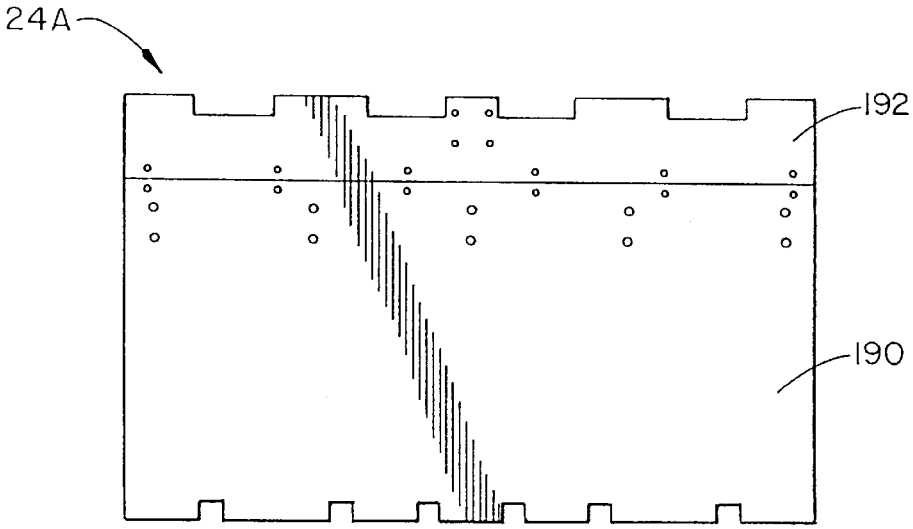
FIG. 24 is a front elevational view of another embodiment of a pusher member for use with the prefeeder assembly of FIG. 1.
Figure 25:
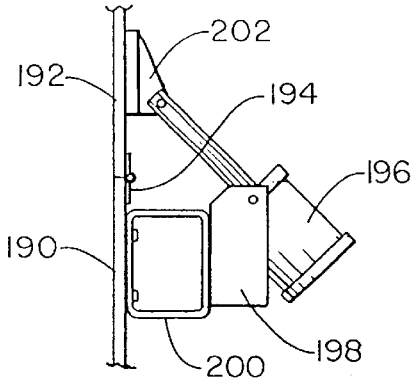
FIG. 25 is a partial, end elevational view of the pusher member of FIG. 24.
Figure 26:
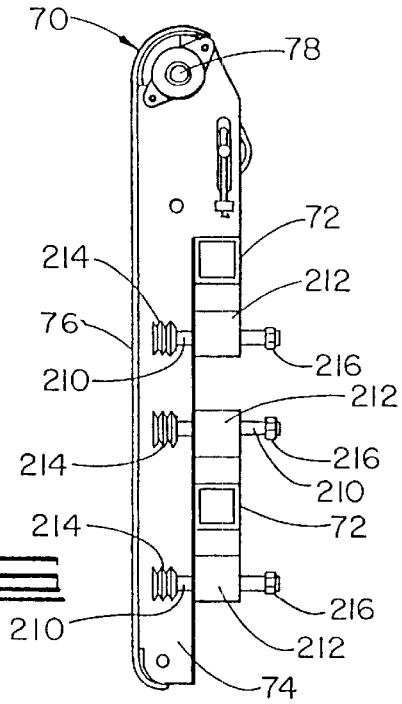
FIG. 26 is a side elevational view of the rotator infeed conveyor as equipped with a dunnage sheet retainer system.

Shown in the views of FIGS. 24 and 25 in the inverted bundle discharge position of the rotator frame 12 (that is, in the position assumed by the pusher member 24A when it is in disposition to push bundles from the stack 28 in the rotator frame 12), the second plate member 192 presents the lower edge of the pusher member that travels along the belts of the rotator infeed conveyor 70 when the rotator frame 12 is in the upright load entry position.

The pneumatic cylinder 196 is connected to a source of compressed air or other working fluid and an appropriate control means so that retraction of the cylinder 196 will rotate the second plate member 192 relatively to the first plate member 190. In the upright load entry position, this will lift the lower edge of the second plate member 192 away from the upper surfaces of the belts 76 of the rotator infeed conveyor 70.

This feature permits the dunnage sheets beneath the incoming stacks 28 to be discarded by propelling the sheets from the rotator infeed conveyor 70 at an appropriate time in the cycle. However, it will be necessary that the dunnage sheet is retained on the infeed conveyor following bundle removal at the inverted bundle discharge position of the rotator frame 12. To accomplish this, a sheet retaining mechanism is provided such as that shown in FIG. 26 which shows the rotator infeed conveyor 70 having a plurality of vacuum tubes 210 that are slidingly supported in oversized bores (not shown) in the support members 212 attached to the cross support members 72.

The vacuum tubes 210 (not shown in FIG. 12) are disposed between the conveyor belts 76 and each such vacuum tube 210 has a flexible bellows end 214 and a connecting end 216 to which a flexible hose attachment to a vacuum source is made. The vacuum tubes 210 are several in number, the total number being determined to be sufficient for the weight of the dunnage sheets incurred with any given application.

When the rotator frame 12 is in its upright load entry position, the vacuum tubes 210 are free to slide via gravity so that the bellows ends 214 are below the plane of the top surfaces of the conveyor belts 76. When a stack 28 having a dunnage sheet thereunder is loaded onto the rotator infeed conveyor 70, the vacuum tubes 210 are not engaged until the rotator frame 12 is rotated to its inverted bundle discharge position at which time vacuum is applied and the vacuum tubes 210 are free to gravitate downwardly to come into contact with the dunnage sheet.

When the lift platform assembly 44 is lowered to permit the pusher member 24A to remove a bundle, the dunnage sheet is held against the inverted rotator infeed conveyor 70 by the vacuum delivered to the vacuum tubes 210. When the rotator frame 12 has been emptied of the last blanks from the stack 28, the vacuum tubes 210 retain the dunnage sheet against the rotator infeed conveyor 70 throughout the time that the rotator frame is reverse rotated to once again assume its upright load entry position. The vacuum to the vacuum tubes 210 is then broken, and the rotator infeed conveyor 70 can be operated to convey the dunnage sheet off of the rotator infeed conveyor 70.

At this time, the pneumatic cylinder 196 is actuated to rotate the second plate member 192 away from the rotator infeed conveyor 70 so that the conveyed dunnage sheet can pass under the lower edge. of the pusher member 24A. If desired, a dunnage sheet discharge conveyor (not shown) can be provided to receive the dunnage sheets discharged from the rotator infeed conveyor 70 so as to deliver the discharged dunnage sheets to a selected disposal point without the need for manual attention.

Figure 27:
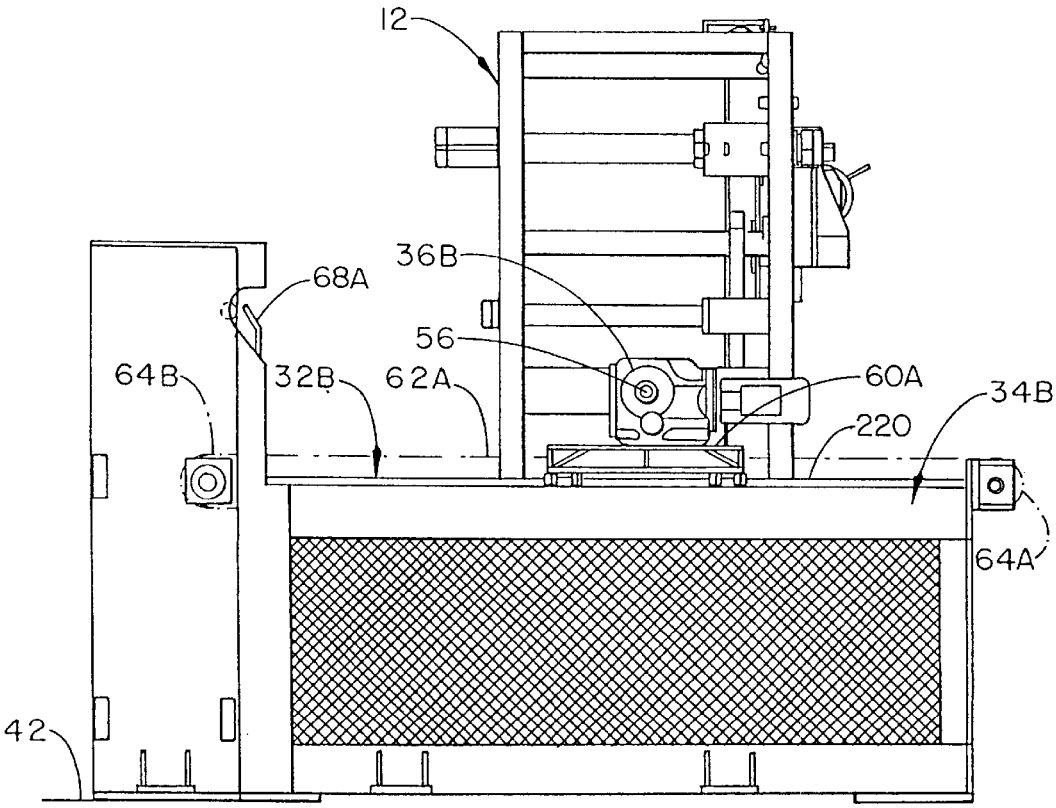
FIG. 27 is a partially cutaway, side elevational view of the prefeeder assembly of FIG. 1 having another embodiment of the rotator frame actuator assembly.

Finally, the embodiment shown in FIG. 27 will now be described. Shown in FIG. 27 is a prefeeder assembly 10A which is identical in construction detail as that described for the prefeeder assembly 10 except as described hereafter. The exception lies in the construction of the means for rotating the rotator frame 12.

FIG. 27 shows a rotator frame actuator assembly 32B which comprises a stationary frame 34B which is a rigid, open box-like structure supported on the floor support 42. The rotator frame 12 is shown supported by the stationary frame 34B. Along each side of the stationary frame 34B is a rail member 220, or equivalent support structure, which moveably supports a pair of travel carts 60A, one on each side of the rotator frame 12. The travel carts 60 are rigid structural members which bearingly support the arbors 56 which extend from the rotator frame 12. A pair of motors 36B are drivingly connected to the arbors 56; that is, the arbors 56 are appropriately keyed and gears are provided on the arbors 56 so that the motors 36B are drivingly connected thereto to selectively rotate the rotator frame 12 when supported on the rotator frame actuator assembly 32B. The motors 36B are preferably encoder controlled so as to be controlled via the aforementioned PLC to rotate the rotator frame 12 in a controlled manner as desired.

Each of the travel carts 60A is connected to a drive chain 62A which is drivingly supported by a pair of sprockets 64B. A motor (not shown) is drivingly connected to drive sprockets (not shown) of each pair of sprockets 64B. The motor is preferably encoder equipped so as to be controlled via the PLC to effect travel of the travel carts 60A in unison along their rail members (or equivalents) to move the supported rotator frame 12 horizontally along the stationary frame 34B.

The stationary frame 32B has protective side panels as shown, one of which is partially cutaway to display a vertically extending plate member 68A which is disposed at entry of the centering conveyor 16 (not shown in FIG. 27). The plate member 68A is shown in FIG. 27 as a visual aid as indicated above.

Figure 28A:
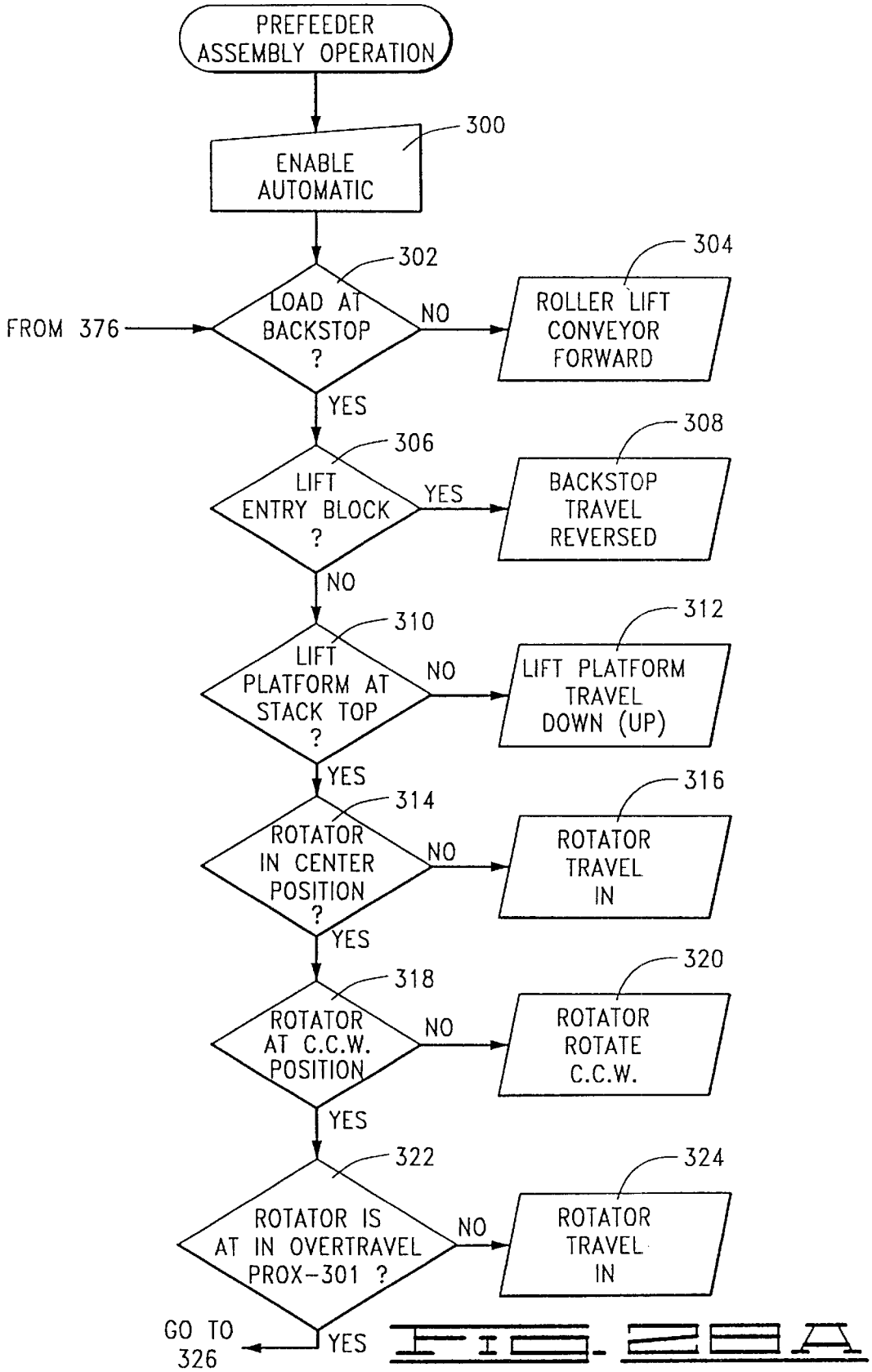
FIGS. 28A through 28C show a flow diagram of the control system of the prefeeder assembly of FIG. 1.
Figure 28B:
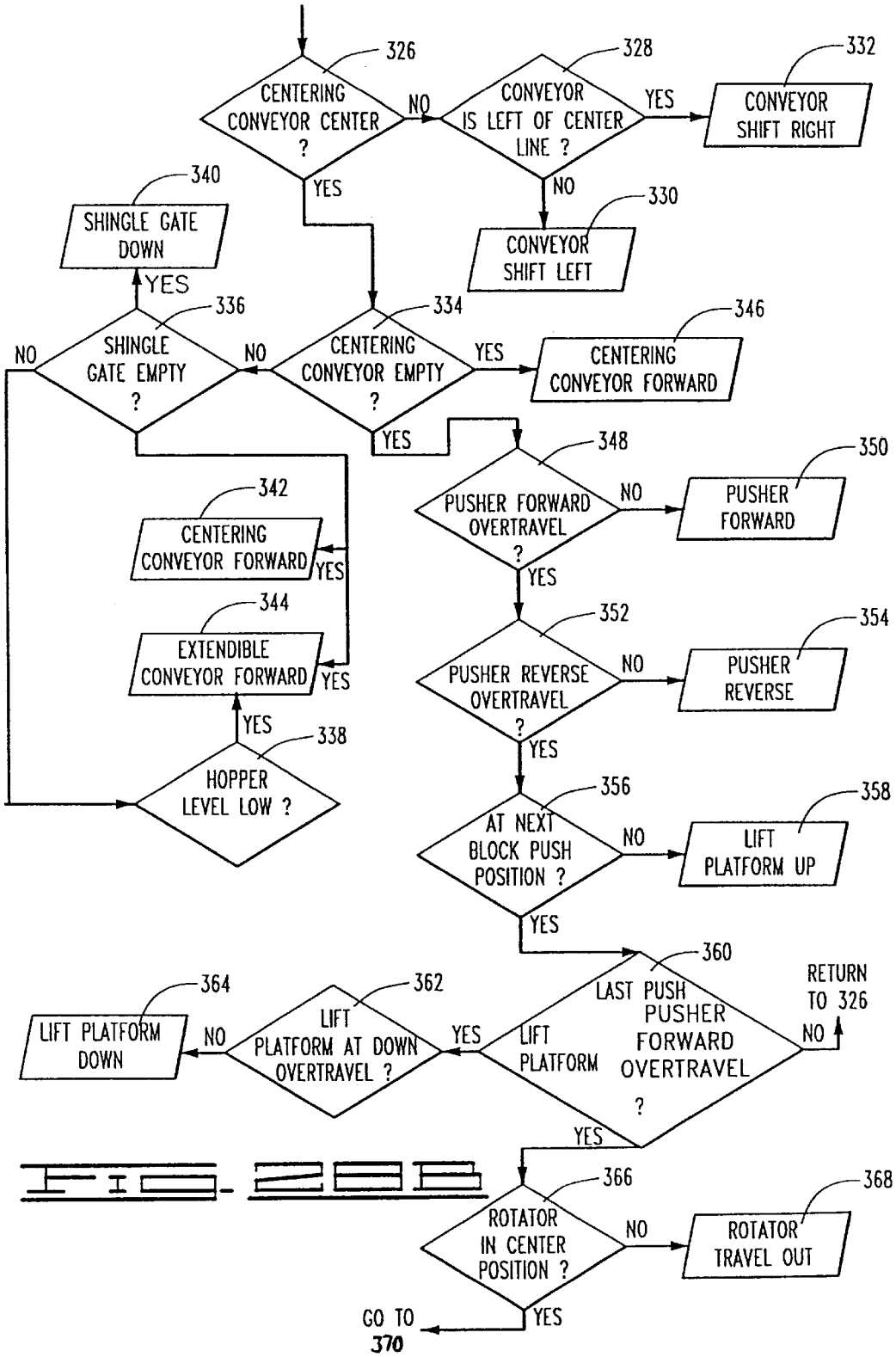
Figure 28C:
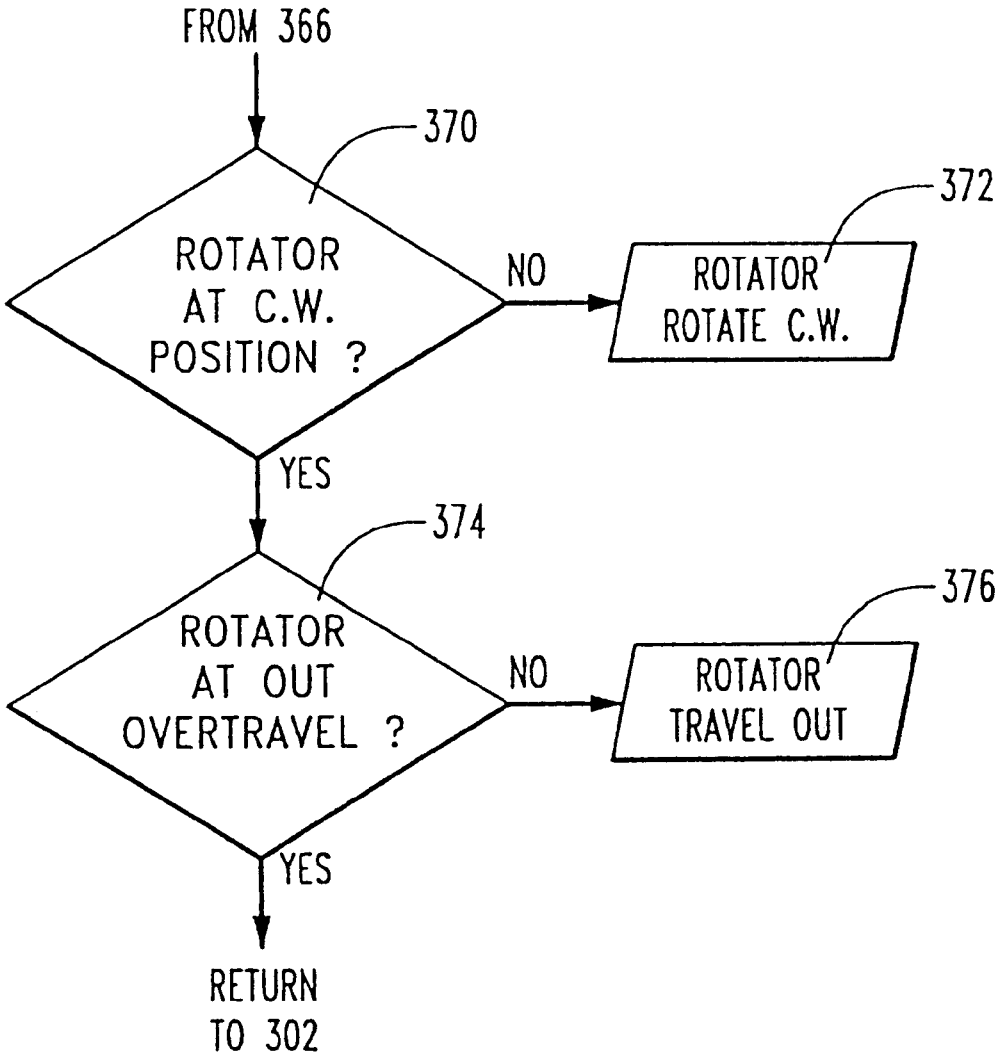

Preferred operation of the prefeeder assembly 10 will now be discussed with reference to FIGS. 28A through 28C, which show a generalized flow chart for the control system of the prefeeder assembly 10. It will be understood that the aforementioned PLC is provided with associated programming to generally carry out the steps set forth in the flow chart.

Prior to operation, the following input conditions are normally established: the length and width of the blanks; the height of the stacks to be received; the desired shingle thickness; the desired hopper level where the blanks are to be delivered to a hopper; the centering load offset; the finish machine configuration; the profile extension for the extendible conveyor; and the speed desired for the extendible conveyor to deliver blanks.

When the automatic operation of the prefeeder assembly 10 is enabled (block 300 in FIG. 28), the PLC checks for a load at the backstop 90 via a photo-eye sensor (PE-310, block 302). If no (that is, there is no load present), the rotator infeed conveyor 70 is engaged to motively move forward (block 304), thereby bringing the stack 28 into the rotator frame 12.

When the presence of a stack 28 is sensed by the photo-eye sensor (PE-310, block 302), the PLC checks to determine whether the load entry photo-eye sensor (PE-309) is blocked (block 306). If yes, the travel of the backstop 90 is reversed (block 308). If no, the PLC checks to determine whether the lift platform assembly 44 is at the top of the stack 28 via the photo-eye sensor (PE-311, block 310). If no, the PLC signals for upward travel of the lift platform assembly 44 (block 312). If yes (the lift platform assembly 44 is at the top of onloaded stack 28), the PLC checks the photo-eye sensor (PE-303) and the photo-eye sensor (PE-304, block 314) to determine whether the rotator frame 12 is in its center position. If no, the rotator frame actuator assembly 32 is activated to move the rotator frame 12 until the rotator frame 12 is in the center position (block 316). If yes (the rotator frame 12 is in the center position), the PLC checks to determine whether the rotator frame 12 is in the counter clock-wise (CCW) or inverted bundle discharge position (block 318). If no, the rotator frame actuator assembly 32 is activated until the rotator frame 12 in the CCW or inverted bundle discharge position (block 320). If yes (the rotator frame 12 is in the CCW or inverted bundle discharge position), the PLC determines whether the rotator frame 12 is at the end of travel position, also sometimes herein referred to as the over travel position, via a proximity sensor (PROX-301, block 322). If no, the rotator frame actuator assembly 32 is actuated to translate the rotator frame 12 via the motor 61 until the rotator frame 12 is in the end of travel position, that is, at the end of its travel position (block 324). If yes (the rotator frame 12 is at the end of travel, or over travel, position), the PLC determines whether the centering conveyor 16 is centered relative to the extendible conveyor 18 (block 326). If no (the centering conveyor 16 is off-center), the PLC checks whether the centering conveyor 16 is left (block 330) or right (block 332) and shifts the centering conveyor 16 via the extendible cylinder 188 in the appropriate direction to center the centering conveyor 16. If yes (the centering conveyor 16 is centered), the PLC checks to determine whether the centering conveyor 16 is empty via the photo-eye sensor (PE-307, block 334).

If no (the centering conveyor 16 is empty), the PLC checks to determine whether the shingling station 20 is empty (block 336). If the centering conveyor 16 is not empty, the PLC checks for a low hopper level (PE-308, block 338). If yes (the hopper is low), the extendible conveyor 18 is activated to move forward (block 344).

If the shingling station 20 is clear (block 340), the shingling station 20 is set in a conventional manner, and the centering conveyor 16 is activated to convey the load forward (block 342) and the extendible conveyor 18 is activated (block 344).

If the centering conveyor 16 is empty, the PLC activates the centering conveyor 16 (block 346) and the PLC determines whether the pusher member 24 is in the forward end of travel, or forward over travel position, a limit switch (LS-207, block 348). If no, the pusher member 24 is moved forward until it reaches the forward overtravel position (block 350). If yes (the pusher member 24 is forward), the PLC checks for the pusher member 24 to move the pusher member 24 to travel to the reverse end of travel, or reverse over travel, position via a limit switch (LS-206, block 352). If no (the limit switch LS-206 is not activated), the pusher member 24 is activated to move in reverse (block 354).

Again, if yes (the limit switch is activated meaning that the pusher member 24 is in the rear or back position), the PLC checks whether the load is in position for the next bundle to be pushed from the stack 28 (block 360). If no, the lift platform assembly 44 is activated to move up (block 358).

When the stack is in position for the next block push, the PLC checks whether this is the last push by checking whether the lift platform assembly 44 is all the way up via the limit switch LS-211, and whether the pusher member 24 is in the forward end of travel, or over travel, position by checking the limit switch LS-207. If both conditions are not met, the PLC restarts the cycle checking whether the centering conveyor 16 is centered (return to block 326). If the lift platform assembly 44 is all the way up, the lift platform assembly 44 is lowered until the limit switch (LS-212, blocks 362, 364) is activated.

If the last push by the pusher member 24 has been made (block 360), the PLC determines whether the rotator frame 12 is in the center position (block 366). If no, the rotator frame actuator assembly 32 is actuated to move the rotator frame 12 motively out (block 368). If the rotator frame 12 is in the center position (block 366), the PLC checks whether the rotator frame 12 is in the CW (clock wise) or upright position (block 370). If no, the rotator frame actuator assembly 32 is caused to rotate the rotator frame 12 in the CW direction (block 372). If yes (the rotator frame 12 is in the CW position), the PLC checks to determine whether the rotator frame 12 is at the out end of travel, or over travel, position (block 374). If no, the rotator frame 12 is moved via the rotator frame actuator assembly 32 to travel motively out (block 376). If the rotator frame 12 is at the out end of travel, or over travel, position (block 374), the PLC restarts the cycle checking if the load is at the back stop by checking photo-eye sensor (PE-310, block 302).

While considerable emphasis has been placed herein on the structures and structural interrelationships between the component parts of the preferred embodiments of the invention, it will be appreciated that many embodiments of the invention can be devised and many changes made in the preferred embodiments without departing from the principles and spirit of the invention. Accordingly, it is to be distinctly understood that the foregoing descriptive matter is to interpreted as illustrative of the invention and not as limiting the invention.

What is claimed is:

1. A prefeeder assembly for receiving a stack of blanks and for inverting and passing the blanks to processing equipment, the prefeeder assembly comprising:

a rotator frame having an upright load entry position and an inverted bundle discharge position;

a rotator frame actuator assembly supporting the rotator frame, the rotator frame actuator assembly having motive means for rotating the rotator frame between the upright load entry position and the inverted bundle discharge position;

a rotator infeed conveyor supported by the rotator frame for receiving and supporting the stack when the rotator frame is in the upright load entry position;

a lift platform assembly supported by the rotator frame and having at least one clamp and support member supported for movement in a first direction toward the rotator infeed conveyor and in a second direction away from the rotator infeed conveyor, the lift platform assembly having motive means for moving the clamp and support member selectively in the first direction and in the second direction; and a backstop and pusher assembly supported by the rotator frame for pushing a selective height of the blanks as a bundle from the stack when the rotator frame is in the inverted bundle discharge position.

2. The prefeeder assembly of claim 1 wherein the backstop and pusher assembly comprises:

a backstop supported by the rotator frame and extending normal to the rotator infeed conveyor;

a pusher member supported by the rotator frame and moveable substantially parallel to the rotator infeed conveyor; and motive means for moving the pusher member.

3. The prefeeder assembly of claim 2 further comprising:

an output conveyor assembly receiving the bundles of blanks moved from the rotatable frame by the pusher member and delivering the bundles to the processing equipment.

4. The prefeeder assembly of claim 3 wherein the backstop is moveably supported by the rotator frame, and wherein the backstop and pusher assembly further comprises:

motive means for moving the backstop substantially parallel to the rotator infeed conveyor to determine the depth of stack receivable into the rotatable frame, the backstop being thus positionable so that the stack is against the backstop when received into the rotatable frame at the upright load entry position thereof.

5. The prefeeder assembly of claim 4 wherein the rotator frame actuator assembly comprises:

means for translating the rotator frame to obtain rotational clearance thereof.

6. The prefeeder assembly of claim 5 wherein the output conveyor assembly comprises:

a longitudinally extending frame assembly having a first end and a second end; and a centering conveyor movably supported at the first end of the longitudinally extending frame assembly, the centering conveyor moveable laterally thereto; and motive means for selectively moving the centering conveyor laterally to the first end of the longitudinally extending frame assembly.

7. The prefeeder assembly of claim 6 wherein the longitudinally extending frame assembly has a longitudinally extendible conveyor in communication with the centering conveyor so that bundles of blanks are transferred therefrom for delivery to the processing equipment.

8. The prefeeder assembly of claim 7 further comprising:

a staging conveyor assembly disposed to move the stack of blanks onto the rotator infeed conveyor.

9. The prefeeder assembly of claim 8 wherein said pusher member comprises:

an upper plate member;

a lower plate member; and hinge means connecting the upper and lower plate members; and means for rotating the lower plate member relative to the upper plate member to provide clearance between the pusher member and the rotator infeed conveyor.

10. The prefeeder assembly of claim 2 wherein the backstop is moveably supported by the rotator frame, and wherein the backstop and pusher assembly further comprises:

motive means for moving the backstop substantially parallel to the rotator infeed conveyor to determine the depth of stack receivable into the rotatable frame, the backstop being thus positionable so that the stack is against the backstop when received into the rotatable frame at the upright load entry position thereof.

11. The prefeeder assembly of claim 10 further comprising a staging conveyor which is disposed to move the stack onto the rotator infeed conveyor.

12. The prefeeder assembly of claim 11 further comprising:

an output conveyor assembly receiving the bundles of blanks moved from the rotatable frame by the pusher member and delivering the bundles to the processing equipment.

13. The prefeeder assembly of claim 12 wherein the output conveyor assembly comprises:

a longitudinally extending frame assembly having a first end and a second end; and a centering conveyor movably supported at the first end of the longitudinally extending frame assembly, the centering conveyor moveable laterally thereto; and motive means for selectively moving the centering conveyor laterally to the first end of the longitudinally extending frame assembly.

14. The prefeeder assembly of claim 13 wherein the longitudinally extending frame assembly has a longitudinally extendible conveyor in communication with the centering conveyor so that bundles of blanks are transferred therefrom for delivery to the processing equipment.

15. The prefeeder assembly of claim 14 wherein the stack of blanks is on a dunnage sheet, the prefeeder assembly further comprising:

means for retaining the dunnage sheet on the rotator infeed conveyor in the inverted bundle discharge position; and wherein said pusher member comprises:

an upper plate member;

a lower plate member; and hinge means connecting the upper and lower plate members; and means for rotating the lower plate member relative to the upper plate member to provide clearance between the pusher member and the rotator infeed conveyor so that the dunnage sheet can be discharged from the rotator infeed conveyor.

16. The prefeeder assembly of claim 15 wherein the means for retaining the dunnage sheet comprises:

a plurality of vacuum nozzles; and support members supporting the vacuum nozzles so that they can gravitate against the dunnage sheet in the inverted bundle discharge position to retain the dunnage sheet against the rotator infeed conveyor.

17. A prefeeder assembly for receiving a stack of blanks and for inverting and passing the blanks to processing equipment, the prefeeder assembly comprising:

a rotator frame having an upright load entry position and an inverted bundle discharge position;

a rotator frame actuator assembly supporting the rotator frame for selectively rotating the rotator frame between the upright load entry position and the inverted bundle discharge position and for moving the rotator frame substantially in a horizontal direction to obtain rotational clearance thereof;

a rotator infeed conveyor supported by the rotator frame receiving and supporting the stack when the rotator frame is in the upright load entry position;

a lift platform assembly supported by the rotator frame and clamping the stack on the rotator infeed conveyor during rotation of the rotator frame from its upright load entry position to its inverted bundle discharge position, the lift platform assembly supporting the inverted stack when the rotator frame is in the inverted bundle discharge position; and a backstop and pusher assembly supported by the rotator frame for pushing a selective height of the blanks as a bundle from the stack supported by the lift platform assembly when the rotator frame that is in the inverted bundle discharge position, the lift platform assembly selectively moving the stack as required for the backstop and pusher assembly to repeatedly move bundles from the stack.

18. The prefeeder assembly of claim 17 wherein the backstop and pusher assembly comprises:

a backstop supported by the rotator frame and extending normal to the rotator infeed conveyor;

a pusher member supported by the rotator frame and moveable substantially parallel to the rotator infeed conveyor; and motive means for moving the pusher member in a direction substantially normal to the backstop.

19. The prefeeder assembly of claim 18 further comprising:

an output conveyor assembly receiving the bundles of blanks moved from the rotatable frame by the pusher member and delivering the bundles to the processing equipment.

20. The prefeeder assembly of claim 19 wherein the backstop and pusher assembly further comprises:

motive means for moving the backstop substantially parallel to the rotator infeed conveyor to adjust and determine the depth of stack receivable into the rotatable frame, the backstop being thus positionable so that the stack is against the backstop when received into the rotatable frame at the upright load entry position thereof.

21. The prefeeder assembly of claim 20 wherein the output conveyor assembly comprises:

a longitudinally extending frame assembly having a first end and a second end; and a centering conveyor movably supported at the first end of the longitudinally extending frame assembly, the centering conveyor moveable laterally thereto; and motive means for selectively moving the centering conveyor laterally to the first end of the longitudinally extending frame assembly.

22. The prefeeder assembly of claim 21 wherein the longitudinally extending frame assembly has a longitudinally extendible conveyor in communication with the centering conveyor so that bundles of blanks are transferred therefrom for delivery to the processing equipment.

23. The prefeeder assembly of claim 22 further comprising a staging conveyor which is disposed to move the stack onto the rotator infeed conveyor.

24. The prefeeder assembly of claim 23 wherein said pusher member has a lower edge which, when the rotator frame is the inverted bundle discharge position, passes in near proximity to the top flat of the stack when pushing the bundle from the stack, and wherein the backstop and pusher assembly further comprises means for raising the lower edge to clear the top flat of the stack.

25. The prefeeder assembly of claim 18 wherein the backstop is moveably supported by the rotator frame, and wherein the backstop and pusher assembly further comprises:

motive means for moving the backstop substantially parallel to the rotator infeed conveyor to adjust and determine the depth of stack receivable into the rotatable frame, the backstop being thus positionable so that the stack is against the backstop when received into the rotatable frame at the upright load entry position thereof.

26. The prefeeder assembly of claim 25 further comprising a staging conveyor which is disposed to move the stack onto the rotator infeed conveyor.

27. The prefeeder assembly of claim 26 further comprising:

an output conveyor assembly receiving the bundles of blanks moved from the rotatable frame by the pusher member and delivering the bundles to the processing equipment.

28. The prefeeder assembly of claim 27 wherein the output conveyor assembly comprises:

a longitudinally extending frame assembly having a proximal end and a distal end;

a centering conveyor movably supported at the proximal end of the longitudinally extending frame assembly, the centering conveyor moveable laterally thereto; and motive means for selectively moving the centering conveyor laterally to the proximal end of the longitudinally extending frame assembly.

29. The prefeeder assembly of claim 28 wherein the longitudinally extending frame assembly has a longitudinally extendible conveyor in communication with the centering conveyor so that bundles of blanks are transferred therefrom for delivery from the distal end to the processing equipment.

30. The prefeeder assembly of claim 29 wherein the stack of blanks is on a dunnage sheet, and wherein the prefeeder assembly further comprises:

means for retaining the dunnage sheet on the rotator infeed conveyor in the inverted discharge position;

wherein the pusher member has a lower edge which, when the rotator frame is in the upright load entry position, passes in proximity to the upper surfaces of the rotator input conveyor; and wherein the backstop and pusher assembly further comprises means for raising the lower edge to clear the top surfaces of the rotator input conveyor to allow discharge of the dunnage sheet from the rotator infeed conveyor.

31. The prefeeder assembly of claim 30 wherein the means for retaining the dunnage sheet comprises:

a plurality of vacuum nozzles; and support members supporting the vacuum nozzles so that they can gravitate against the dunnage sheet in the inverted bundle discharge position to retain the dunnage sheet against the rotator infeed conveyor.

* * * * *